US009610782B2

(12) United States Patent
Toya et al.

(10) Patent No.: US 9,610,782 B2
(45) Date of Patent: Apr. 4, 2017

(54) DRYING DEVICE, PRINTING APPARATUS, AND DRYING METHOD

(71) Applicant: SEIKO EPSON CORPORATION, Tokyo (JP)

(72) Inventors: Akihiro Toya, Nagano (JP); Jun Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/943,117

(22) Filed: Nov. 17, 2015

(65) Prior Publication Data

US 2016/0144633 A1 May 26, 2016

(30) Foreign Application Priority Data

Nov. 26, 2014 (JP) ..... 2014-238482

(51) Int. Cl.

| | |
|---|---|
| ***B41J 29/377*** | (2006.01) |
| ***B41J 2/435*** | (2006.01) |
| ***B41J 11/00*** | (2006.01) |
| ***B41J 15/16*** | (2006.01) |

(52) U.S. Cl.

CPC ..... *B41J 11/002* (2013.01); *B41J 15/16* (2013.01)

(58) Field of Classification Search

CPC .. B41J 11/002; B41J 2025/008; B41J 29/377; B41J 11/02; B41J 11/18; B41J 11/0045; B41J 2/435; B41J 2/44; B41J 2/447; B41J 2/45; B41J 2/475; B41J 2002/4756; B41J 13/223; B41J 13/226

USPC ..... 347/102

See application file for complete search history.

(56) References Cited

U.S. PATENT DOCUMENTS

| | | | | |
|---|---|---|---|---|
| 2007/0147937 | A1* | 6/2007 | Hioki | B41J 15/044 400/613 |
| 2010/0194812 | A1* | 8/2010 | Castells | B41J 29/38 347/16 |
| 2012/0013671 | A1 | 1/2012 | Houjou | |
| 2013/0044170 | A1* | 2/2013 | Chiwata | B41J 11/0015 347/102 |
| 2013/0100198 | A1 | 4/2013 | Kanome et al. | |
| 2013/0278668 | A1* | 10/2013 | Miyamoto | B41J 11/002 347/17 |

FOREIGN PATENT DOCUMENTS

| | | |
|---|---|---|
| JP | 2004-018185 A | 1/2004 |
| JP | 2012-020548 A | 2/2012 |
| JP | 2013-086476 A | 5/2013 |

* cited by examiner

*Primary Examiner* — Geoffrey Mruk
*Assistant Examiner* — Scott A Richmond
(74) *Attorney, Agent, or Firm* — Global IP Counselors, LLP

(57) ABSTRACT

A drying device for drying a medium that has had a liquid ejected thereon includes a guide that the medium that has had the liquid ejected thereon abuts against, a tension control section that is capable of providing tension to the medium that is abutted against the guide, a heating section capable of heating the medium, and a cooling section capable of cooling the medium that has been heated by the heating section, wherein the tension control section is capable of generating a pressing force that presses the medium against the guide, and the heating by the heating section and the cooling by the cooling section are performed on the medium while the tension and the pressing force are being applied to the medium.

20 Claims, 3 Drawing Sheets

DRYING DEVICE, PRINTING APPARATUS, AND DRYING METHOD

BACKGROUND

1. Technical Field

The present invention relates to a technology for drying a medium that has had a liquid ejected thereon.

2. Related Art

Regarding a printing technology that transports a medium such as paper that has been wound up into a roll, and that forms an image by ejecting ink onto the medium while the medium is being transported, in order to prevent transfer of ink to rollers that abut against the medium after printing has been performed, a technology for heating and drying ink that has been ejected onto a medium has been proposed (for example, JP-A-2013-86476, JP-A-2004-18185, JP-A-2012-20548).

Moreover, in order to suppress deformation of the medium, there is a known technology for heating and drying a medium in a state where the medium is pressed against a guide such as a drum (for example, JP-A-2012-20548).

In order to dry ink, it is necessary to give the ink that is on the medium an amount of heat necessary for the evaporation of the solvent. However, because the medium is also heated, a malfunction may occur in which the medium deforms due to heating. As in the technology of JP-A-2012-20548, it is possible to suppress deformation of a medium during heating by heating the medium while the medium is pressed against a guide such as a drum. However, a force (for example, tension or a force that presses a substrate against the guide) that was applied to a substrate is released at the location where the medium separates from the guide after having been heated. At this time, if the temperature of the substrate remains high as a result of heating, there may be a problem in that the above-mentioned deformation of the substrate occurs.

Such a problem is not limited to a technology in which a medium that has been wound up into a roll is transported and ink is ejected onto the medium, but may also occur in a technology in which a medium that has had a liquid ejected thereon is heated and dried.

SUMMARY

The invention is capable of being implemented as the following aspects.

(1) According to an aspect of the invention, a drying device for drying a medium that has had a liquid ejected thereon is provided. This drying device includes a guide that the medium that has had the liquid ejected thereon abuts against, a tension control section that is capable of providing tension to the medium that is abutted against the guide, a heating section capable of heating the medium, and a cooling section capable of cooling the medium that has been heated by the heating section, wherein the tension control section is capable of generating a pressing force that presses the medium against the guide, and the heating by the heating section and the cooling by the cooling section are performed on the medium while the tension and the pressing force are being applied to the medium.

According to the drying device of this aspect, the cooling of the medium, as well as the heating of the medium, is performed while the medium is abutted against the guide and while tension is provided to the medium and a pressing force is generated on the medium. Consequently, because it is possible to cool the medium before the medium separates from the guide, it is possible to suppress deformation of the medium after drying.

(2) In the drying device of the above aspect, the guide may be a transport drum that has a cylindrical form and that transports the medium on a circumferential surface of the transport drum.

According to the drying device of this aspect, because it is possible to reduce the frictional resistance between the medium and the guide by transporting the medium by the transport drum, the likelihood of the medium being damaged can be decreased.

(3) In the drying device of the above aspect, the guide may abut against the medium and include a convex curved surface that protrudes toward the medium.

According to the drying device of this aspect, it is possible to easily generate a pressing force due to the convex curved surface. For example, it is possible to generate a pressing force by applying tension to the medium in a direction along the curved surface.

(4) According to another aspect of the invention, a printing apparatus is provided. This printing apparatus includes an ejecting section that ejects a liquid onto a medium and the drying device of the above aspect.

According to the printing apparatus of this aspect it is possible to suppress deformation of the medium after drying.

(5) According to another aspect of the invention, a drying method that dries a medium that has had a liquid ejected thereon is provided. This drying method includes abutting the medium that has had the liquid ejected thereon against a guide, providing tension to the medium that is abutting against the guide, heating the medium, and cooling the medium that has been heated, wherein the providing of the tension to the medium includes generating a pressing force that presses the medium against the guide, and the heating of the medium and the cooling of the medium are performed while the medium is abutted against the guide by the abutting of the medium against the guide and while the tension is provided to the medium and the pressing force is generated on the medium by the providing of the tension to the medium.

According to the drying method of this aspect, because the cooling of the medium, as well as the heating of the medium, is performed while the medium is abutted against the guide and while a tension is provided to the medium and a pressing force is generated on the medium, it is possible to suppress deformation of the medium after drying.

Further, the invention may be implemented in various forms other than the drying device, the printing apparatus and the drying method. For example, the invention may be implemented as a printing method, a printing system including a printing apparatus, a control method for a drying device and the printing apparatus, a computer program that realizes such a control method, a tangible storage medium on which the computer program is stored, a print medium manufactured using the above-mentioned devices and methods, and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
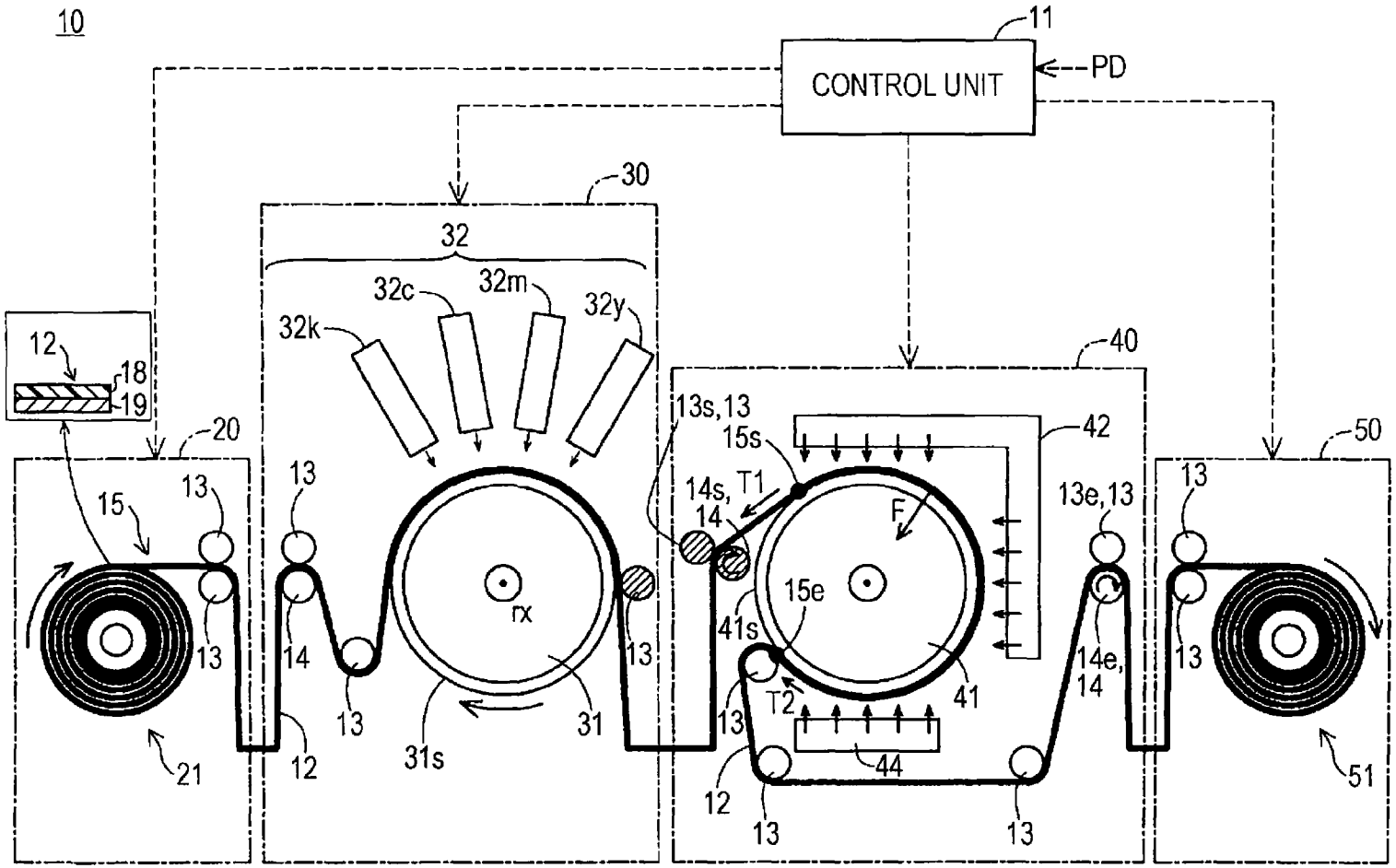
FIG. 1 is a structural diagram of a printing apparatus according to a first embodiment of the present invention.

FIG. 1 is a structural diagram of a printing apparatus 10 according to a first embodiment of the invention. The printing apparatus 10 of this embodiment is an ink jet type line printer that forms an image by ejecting ink droplets onto a printing substrate 12 serving as a medium. This printing apparatus 10 performs continuous printing on the printing substrate 12 that is belt-shaped and transported in the lengthwise direction. In this embodiment, the printing substrate 12 is a member formed of a plurality of layers. Specifically, the plurality of layers include a first layer 18 that forms a front surface (print surface) on which a printing image such as a character or graphic is formed by ejecting ink and a second layer 19 that forms a rear surface that is arranged so as to overlap the first layer 18. The first layer 18 and the second layer 19 are detachably attached to each other with an adhesive agent such as a paste. The first layer 18 is, for example, a film formed of a synthetic resin such as polyethylene (PE), polypropylene (PP), or polyethylene terephthalate (PET). Further, the second layer 19 is, for example, a thin sheet formed of paper, which is made from vegetable fibers, or PET. In this embodiment, the first layer 18 has a lower heat resistance (for example, glass transition temperature) than the second layer 19. Consequently, the first layer 18 can deform at a lower temperature than the second layer 19. Further, the first layer 18 of this embodiment is formed as a film by enlarging a pre-processed member while heating it. Consequently, the first layer 18 shrinks as a result of being heated up to a predetermined temperature (for example, temperature at which enlargement occurs).

The printing apparatus 10 includes a control section 11, a plurality of transport rollers 13, a plurality of drive rollers 14, a substrate delivery section 20, a print execution section 30, a drying section 40, and a substrate winding section 50. The control section 11 is formed of a microcomputer including a central processing section and a main memory section, and is capable of controlling each of the components of the printing apparatus 10. The control section 11 acquires print data PD from external computers and the like connected thereto and carries out print processing based on the print data PD in accordance with the instructions from a user. The print data PD serving as image data may be, for example, document data expressing laid out characters and graphics, raster data of photographic images or the like, or image data created by various application programs.

The plurality of transport rollers 13 and the plurality of drive rollers 14 form a transport path 15 along which the printing apparatus 10 transports the printing substrate 12 in the lengthwise direction. The plurality of transport rollers 13 and the plurality of drive rollers 14 are arranged in such a manner that the substrate delivery section 20, the print execution section 30, the drying section 40 and the substrate winding section 50 are connected in this order along the transport path 15. Hereafter, the substrate delivery section 20 side of the transport path 15 will be referred to as the "upstream side" and the substrate winding section 50 side of the transport path 15 will be referred to as the "downstream side". The transport rollers 13 are driven rollers that do not have a drive source such as a motor. The drive rollers 14 have a motor and rotary movement of the drive rollers 14 is controlled by driving of the motor controlled by the control section 11 in accordance with a signal from the control section 11. Here, in the transport path 15, it is preferable that the transport rollers 13 and the drive rollers 14 positioned between a point further downstream than a print head section 32 and a point at which drying by the drying section 40 has ended (in FIG. 1, the rollers having the crosshatching) be formed in the following manner. That is, it is preferable that the transport rollers 13 and the drive rollers 14 that have the crosshatching in FIG. 1 be formed in such a manner that the printing substrate 12 is nipped at both sides of the printing substrate 12 in the width direction (that is, a portion outside the area that is to be printed on). By doing this, because it is possible to suppress ink that has been applied to the printing substrate 12 and that has not dried yet from attaching to the transport rollers 13 and the drive rollers 14, it is possible to suppress a reduction in the image quality of the print image formed on the printing substrate 12.

The substrate delivery section 20 includes a substrate roller 21 around which the printing substrate 12 is wound up into a roll. The substrate roller 21 is made to rotate at a fixed rotational speed by a motor (not illustrated) controlled by the control section 11, and feeds out the printing substrate 12 from the substrate roller 21 to the print execution section 30.

The print execution section 30 includes a transport drum 31 and the print head section 32 and forms a print image on a print surface of the printing substrate 12. The transport drum 31 rotates at a fixed rotational speed by a motor (not illustrated) controlled by the control section 11. The transport drum 31 transports the printing substrate 12 while a circumferential surface 31*s* of the transport drum 31 is in surface contact with and supporting the rear surface of the printing substrate 12 that is on the opposite side to the print surface of the printing substrate 12. In short, the transport drum 31 forms one part of the transport path 15. The transport drum 31 included in the print execution section 30, the drive rollers 14, and the plurality of transport rollers 13 are formed in such a manner that they are capable of providing, along the lengthwise direction, tension to the printing substrate 12 on the circumferential surface 31*s* of the transport drum 31.

The print head section 32 includes four liquid ejecting heads 32*k*, 32*c*, 32*m*, and 32*y*. The liquid ejecting heads 32*k* to 32*y* are line heads that eject droplets at a predetermined timing and size in accordance with an instruction of the control section 11. When the printing substrate 12 passes through the print head section 32, an image layer that forms the print image is formed on the surface of the printing substrate 12 by ejecting droplets from the liquid ejecting heads 32*k* to 32*y*. The liquid ejecting heads 32*k* to 32*y* are radially arranged about a rotational axis rx of the transport drum 31 in such a manner that each nozzle opposes the circumferential surface 31*s* of the transport drum 31 so that each droplet can be ejected onto the print area of the printing substrate 12. That is, in the printing apparatus 10 of this embodiment, the transport drum 31 functions as a so-called platen. The first liquid ejecting head 32*k* ejects black ink. The second liquid ejecting head 32*c* ejects cyan ink. The third liquid ejecting head 32*m* ejects magenta ink. The fourth liquid ejecting head 32*y* ejects yellow ink. Each ink is a water-based pigmented ink in which water is used as the main solvent. Moreover, instead of using water-based pigmented ink for each ink, other types of ink may be used (for example, dye ink and ink that uses an organic solvent as the solvent for the pigment). Further, the order in which the liquid ejecting heads are arranged is not limited to that of this embodiment and other arrangements may be used.

The drying section 40 that serves as a drying device includes a transport drum 41 that serves as a guide, a heating section 42 that is capable of heating the printing substrate 12, and a cooling section 44 that is capable of cooling the printing substrate 12 that has been heated by the heating section 42.

The printing substrate 12 that has passed through the print execution section 30 and onto which ink has been ejected abuts against the transport drum 41. The transport drum 41 is a cylinder that rotates in accordance with the transport of the printing substrate 12. A circumferential surface 41*s* of the transport drum 41 is, for example, formed of a metal such as stainless steel. The circumferential surface 41*s* abuts against the printing substrate 12 and can be said to be a convex curved surface that protrudes toward the printing substrate 12. The transport drum 41 has the circumferential surface 41*s* thereof in surface contact with and supporting the rear surface of the printing substrate 12 that is on the opposite side to the print surface of the printing substrate 12. In other words, the transport drum 41 forms one part of the transport path 15. In this embodiment, within the circumferential surface 41*s* of the transport drum 41, the point at which surface contact between the printing substrate 12 and the transport drum 41 starts is called a contact start point 15*s*, and the point at which surface contact between the printing substrate 12 and the transport drum 41 ends is called a contact end point 15*e*. Moreover, the transport drum 41 may include a motor for rotating the transport drum 41 having a circumferential surface 41*s* in the transport direction.

Transport rollers 13*s* and 13*e*, and drive rollers 14*s* and 14*e* that are included in the drying section 40 are formed in such a manner that they are capable of providing, along the lengthwise direction (transport direction), tension to the printing substrate 12 on the circumferential surface 41*s* of the transport drum 41. Specifically, by performing control so as to make the rotational speed of the drive roller 14*e* that is downstream higher than the rotational speed of the drive roller 14*s* that is upstream, tension T1 is provided to an end portion of the printing substrate 12 on the contact start point 15*s* side, and tension T2 is provided to an end portion of the printing substrate 12 on the contact end point 15*e* side. Here, the transport rollers 13*s* and 13*e* and the drive rollers 14*s* and 14*e* are considered to be equivalent to the "tension control section" described in "SUMMARY". By providing the printing substrate 12 with the tensions T1 and T2 in the lengthwise direction of the printing substrate 12, a pressing force F that presses the printing substrate 12 against the circumferential surface 41*s* of the transport drum 41 is generated. Even though the pressing force F is generated throughout the printing substrate 12 from the contact start point 15*s* of the printing substrate 12 to the contact end point 15*e* of the printing substrate 12, only one representative point is illustrated in FIG. 1.

The heating section 42 is provided at a position opposite the circumferential surface 41*s* with the printing substrate 12 therebetween. The heating section 42 heats and dries a portion of the printing substrate 12 located between the contact start point 15*s* and the contact end point 15*e*. Specifically, the heating section 42 blows out air that has been heated by an electrical heating wire onto the surface of the printing substrate 12. Consequently, the printing substrate 12 is heated, the water content of the ink that has been ejected onto the surface of the printing substrate 12 evaporates and the printing substrate 12 is dried. The temperature of the air that the heating section 42 blows onto the printing substrate 12 (the temperature of the air outlet of the heating section 42) may be adjusted in accordance with the type of printing substrate 12, the amount of ink ejected or the like, or may be set to a fixed temperature (for example, in the range of 70° C. to 100° C.).

The cooling section 44 is arranged at a position opposite the circumferential surface 41*s* with the printing substrate 12 therebetween. The cooling section 44 cools a portion of the printing substrate 12 located between the contact start point 15*s* and the contact end point 15*e*. In detail, the printing substrate 12 is cooled after being heated by the heating section 42. The cooling section 44 is an air blower that cools the printing substrate 12, which has been heated, by blowing room-temperature air onto the printing substrate 12. The amount of air ($m^3$/h) blown toward the printing substrate 12 by the cooling section 44 may be adjusted in accordance with the heating conditions of the heating section 42 or the like, or may be set to a fixed amount of air. Further, the amount of air blown out by the cooling section 44 may be controlled so that the temperature at the contact end point 15*e* of the printing substrate 12 is preferably 40° C. or lower, or more preferably 30° C. or lower.

The substrate winding section 50 includes a winding roller 51 that rotates at a fixed rotational speed in accordance with an instruction of the control section 11. The winding roller 51 winds the printing substrate 12 that has been fed out from the drying section 40. The printing substrate 12 that has been wound up by the substrate winding section 50 is cut off at a fixed size and the first layer 18 is peeled off the second layer 19 and is used as a film product.

Figure 2:
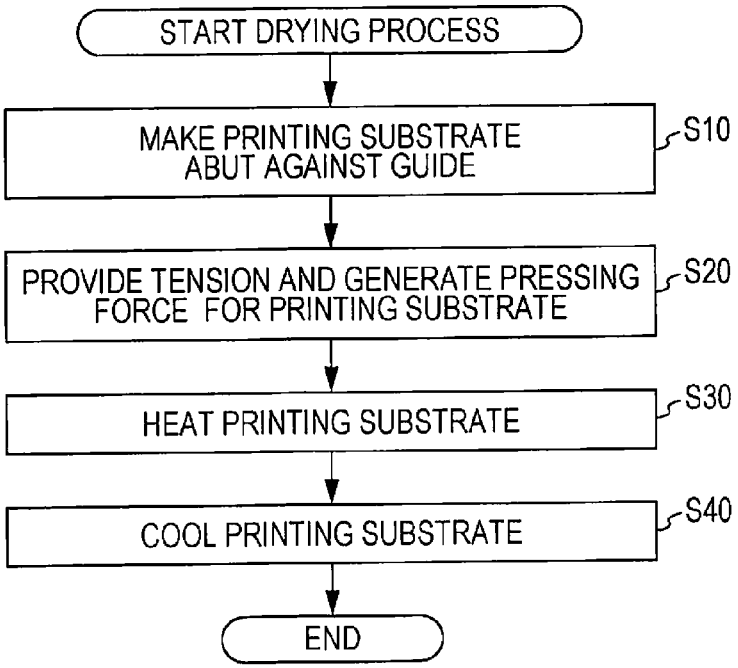
FIG. 2 is a flow diagram of a drying process performed by a drying section.

FIG. 2 is a flow diagram of the drying process performed by the drying section 40. This drying process is performed on the printing substrate 12 onto which ink has been ejected by the print execution section 30. The printing substrate 12 onto which ink has been ejected is fed out toward the transport drum 41 by a drive roller 14*s* (FIG. 1) and is made to abut against the circumferential surface 41*s* of the transport drum 41 (guide) (step S10). Further, once print processing has been started, each of the drive rollers 14, the substrate roller 21, the winding roller 51 and the like rotate in order to transport the printing substrate 12 from the upstream side to the downstream side, and the printing substrate 12 is transported from the substrate roller 21 toward the winding roller 51. At this time, tension is provided to the printing substrate 12 on the circumferential surface 41*s* in the lengthwise direction (transport direction) of the printing substrate 12 by the transport rollers 13*s* and 13*e*, and by the drive rollers 14*s* and 14*e* (step S20). This provision of tension is maintained at least between the drying of the printing substrate 12 by the heating section 42 and the cooling of the printing substrate 12 by the cooling section 44. Further, a pressing force F (FIG. 1) is generated in step S20.

The heating section 42 heats and dries the printing substrate 12 that has passed the contact start point 15*s* (step S30). Thereafter, the cooling section 44 cools the printing substrate 12 (step S40) by blowing air onto the printing substrate 12 that was heated in step S30. The printing substrate 12 that has undergone step S40 is fed out toward the winding roller 51 by the drive roller 14*e* and the like and is wound up by the winding roller 51. The above-mentioned step S30 and step S40 are performed on the same portion of the printing substrate 12 on the transport drum 41.

Here, in the printing substrate 12 of this embodiment, the first layer 18 has a lower thermal resistance than the second layer 19, and is more likely to shrink at a lower heating temperature. For the printing substrate 12 of this type, for example, in the case where cooling has not been performed by the cooling section 44 or in the case where cooling is performed downstream of the contact end point 15*e*, the printing substrate 12 in a high temperature state will separate from the transport drum 41. In this case, because the apparent rigidity of the printing substrate 12 decreases as a result of the printing substrate 12 separating from the transport drum 41, with the printing substrate 12 being in a high temperature state, a tunneling phenomenon may occur and stripe-like wrinkles may form on the first layer 18. However, according to the above embodiment, cooling of the printing substrate 12, as well as heating of the printing substrate 12, is performed while keeping the printing substrate 12 in contact with the transport drum 41, providing the printing substrate 12 with tension T1 and tension T2, and generating a pressing force F on the printing substrate 12.

As a result, it is possible to cool the printing substrate 12 before the printing substrate 12 separates from the transport drum 41. After making the rigidity of the printing substrate 12 higher than that just after heating, which is achieved by cooling the printing substrate 12, the printing substrate 12 ceases to be wound by the transport drum 41. Consequently, it is possible to suppress deformation of the printing substrate 12 after it has been separated from the transport drum 41. Moreover, even in the case where the printing substrate 12 has a low thermal resistance, by cooling the printing substrate 12 with the cooling section 44 while keeping the printing substrate 12 in contact with the transport drum 41, providing the printing substrate 12 with tension T1 and tension T2, and generating a pressing force F on the printing substrate 12, it is possible to perform drying by the heating section 42 at temperatures higher than usual. Consequently, because it is possible to increase the transportation speed of the printing substrate 12, the efficiency with which the printing substrate 12 is produced can be improved.

Further, in the above embodiment, the transport drum 41 is used as a guide against which the printing substrate 12 is abutted. Consequently, because the frictional resistance between the printing substrate 12 and the circumferential surface 41*s* can be lowered by transporting the printing substrate 12 through rotation of the transport drum 41, the likelihood of the printing substrate 12 being damaged can be decreased. Further, due to the circumferential surface 41*s* having a convex curved surface and by providing the printing substrate 12 with tension T1 and tension T2, it is easy to generate the pressing force F.

B. Second Embodiment

Figure 3:
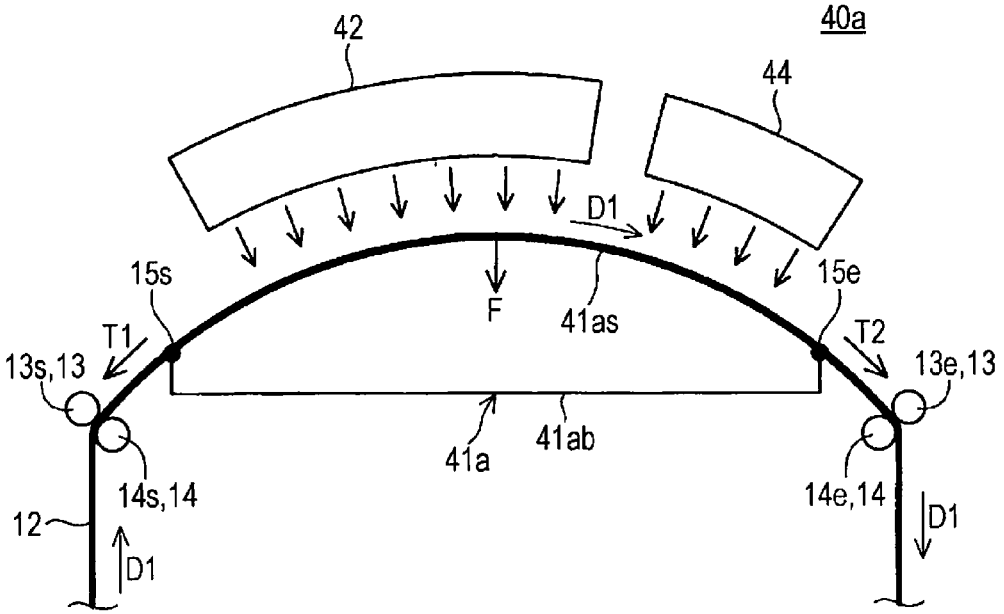
FIG. 3 is a diagram for explaining a drying section of a second embodiment.

FIG. 3 is a diagram for explaining a drying section 40*a* of the second embodiment. The drying section 40*a* of the second embodiment can be used in the printing apparatus 10 (FIG. 1) instead of the drying section 40. The main difference between the drying section 40*a* of the second embodiment and the drying section 40 of the first embodiment is that, in the second embodiment, a guide 41*a* is used instead of the transport drum 41. Moreover, regarding the drying section 40*a* which has substantially the same structure as the drying section 40 of the first embodiment, the same reference signs are used and explanation thereof is omitted.

The guide 41*a* includes a curved surface 41*as* that forms one surface of the guide 41*a* and a rear surface 41*ab* that forms another surface of the guide 41*a*. The curved surface 41*as* is a portion that the printing substrate 12 abuts against and is a protrusion that protrudes toward the printing substrate 12. The curved surface 41*as* of this embodiment forms an arc along the transport direction D1. The curved surface 41 as is, for example, formed of a metal such as stainless steel. The rear surface 41*ab* is a flat surface and abuts against an arrangement surface on which the guide 41*a* is arranged (not illustrated). The guide 41*a* is a portion that has a fixed length that is longer than the width of the printing substrate 12 in the depth direction of the page. Without the guide 41*a* rotating, only the printing substrate 12 moves on the curved surface 41*as* in the transport direction D1.

The transport rollers 13*s* and 13*e*, and the drive rollers 14*s* and 14*e*, in the same manner as in the first embodiment, provide the printing substrate 12 with tension T1 and tension T2 in the lengthwise direction (transport direction) of the printing substrate 12 that is on the curved surface 41*as* of the guide 41*a*. By providing the tension T1 and tension T2, a pressing force F that presses the printing substrate 12 against the curved surface 41*as* of the guide 41*a* is generated.

The heating section 42, in the same manner as in the first embodiment, heats and dries a portion of the printing substrate 12 located between the contact start point 15*s* and the contact end point 15*e*. The cooling section 44, in the same manner as in the first embodiment, cools a portion of the printing substrate 12 that has been heated by the heating section 42, the portion being located between the contact start point 15*s* and the contact end point 15*e*. The heating by the heating section 42 and the cooling by the cooling section 44 are performed while keeping the printing substrate 12 in contact with the curved surface 41*as* of the guide 41*a*, and by providing the printing substrate 12 with tension T1 and tension T2 and generating a pressing force F on the printing substrate 12.

Because the above-mentioned second embodiment has substantially the same configuration as the first embodiment, substantially the same effect as the first embodiment is achieved. For example, by cooling the printing substrate 12 before the printing substrate 12 separates from the guide 41*a*, it is possible to suppress deformation of the printing substrate 12 after it has been separated from the guide 41*a*.

C. Third Embodiment

Figure 4:
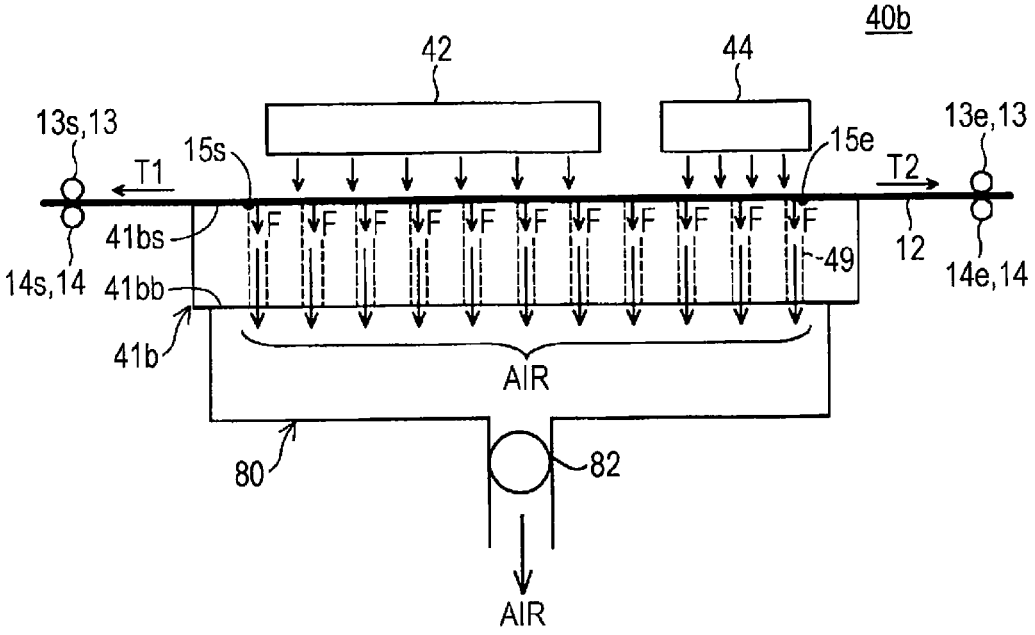
FIG. 4 is a diagram for explaining a drying section of a third embodiment.

FIG. 4 is a diagram for explaining a drying section 40*b* of the third embodiment. The drying section 40*b* of the third embodiment can be used in the printing apparatus 10 (FIG. 1) instead of the drying section 40. The main difference between the drying section 40*b* of the third embodiment and the drying section 40 of the first embodiment is the structure of a guide 41*b* against which the printing substrate 12 abuts and the provision of a suction section 80. Regarding the structure, which is substantially the same as that of the drying section 40 of the first embodiment, the same reference signs are used and explanation thereof is omitted.

The guide 41*b* is a plate-like portion. A front surface 41*bs* of the guide 41*b* is a flat surface and is a portion against which the printing substrate 12 abuts. The front surface 41*bs* is, for example, formed of a metal such as stainless steel. The guide 41*b* has a plurality of suction holes 49 that extend from the front surface 41*bs* to a rear surface 41*bb* formed therein. The suction holes 49 are in communication with the suction section 80. The suction section 80 expels air inside to the outside by using a fan 82. Consequently, the pressure in the suction holes 49 is made to be a negative pressure and a pressing force F that presses the printing substrate 12 against the guide 41*b* is generated. Here, the transport rollers

13*s* and 13*e*, the drive rollers 14*s* and 14*e*, and the suction section 80 are considered to be equivalent to the "tension control section" described in "SUMMARY". The heating by the heating section 42 and the cooling by the cooling section 44 for the printing substrate 12 are performed while providing the printing substrate 12 with tension T1 and tension T2 in the longitudinal direction of the printing substrate 12 by using the transport rollers 13*s* and 13*e*, and the drive rollers 14*s* and 14*e*, and while generating a pressing force F on the printing substrate 12 by using the suction section 80.

Because the above-mentioned third embodiment has substantially the same configuration as the first embodiment, substantially the same effect as the first embodiment is achieved. For example, by cooling the printing substrate 12 before the printing substrate 12 separates from the guide 41*b*, it is possible to suppress deformation of the printing substrate 12 after it has been separated from the guide 41*b*.

D. Modifications

Further, the invention is not limited to the above-mentioned examples and embodiments, and can be realized in various ways as long as it does not deviate from the scope of the invention, for example, the following modifications are possible.

D-1 First Modification

The printing substrate 12 (FIG. 1) is not limited to including two layers, namely, the first layer 18 and the second layer 19, and may include three or more layers or may be just one single layer. In this way, by using the drying sections 40 to 40*b* of the above-mentioned respective embodiments, in the printing process it is possible to suppress deformation of the printing substrate 12 such as the formation of stripe-like wrinkles (troughs) or the like. Moreover, the printing substrate 12 can be any of various media capable having a liquid ejected thereon and fixed thereon. For example, a substrate of glossy paper, coated paper, OHP film, or the like can be used as the printing substrate 12. Further, the printing substrate 12 is not limited to the above-mentioned substrate and may be a substrate having high liquid absorbency such as plain paper, Japanese paper, ink jet printer paper or the like. Moreover, the invention can be used with a medium onto which a liquid is ejected and that deforms, for example, shrinks as a result of being heated.

D-2 Second Modification

Regarding the above-mentioned embodiments, heating of the printing substrate 12 is not limited to blowing air heated by the heating section 42 onto the printing substrate 12 but may be achieved by any structure capable of heating the printing substrate 12. For example, the inside portion (inner side) of a structure that supports the printing substrate 12 and that is one part of the transport path (for example, the transport drum 41 or the guides 41*a* and 41*b*) may be provided with a heater serving as the heating section 42. Further, in the above-mentioned embodiments, an air blower is used as the cooling section 44, however, the cooling section 44 is not limited to this and any structure capable of decreasing the temperature of the printing substrate 12 that has been heated by the heating section 42 may be used. For example, a structure capable of absorbing the heat of the printing substrate 12 by using a fluid (for example, room-temperature air or cooled air) that cools the printing substrate 12 may be used. To be more specific, for example, the cooling section 44 may be a structure capable of hitting the printing substrate 12 with cool air having a temperature lower than room temperature, making a cooling fluid flow in the inside portion (inner side) of a structure (for example, the transport drum 41 or the guides 41*a* and 41*b*) that supports the printing substrate 12 and that is one part of the transport path, or cooling the printing substrate 12 via the circumferential surface 41*s* by cooling a portion of the circumferential surface 41*s*.

D-3 Third Modification

In the above-mentioned embodiment, the tension T1 and tension T2 are in the lengthwise direction of the printing substrate 12, however, it is acceptable for the tension to be applied in the in-plane direction of the printing substrate 12. For example, tension may be applied along the short length direction (width direction) of the printing substrate 12.

This application claims priority to Japanese Patent Application No. 2014-238482 filed on Nov. 26, 2014. The entire disclosure of Japanese Patent Application No. 2014-238482 is hereby incorporated herein by reference.

What is claimed is:

1. A drying device for drying a medium that has had a liquid ejected thereon and has been transferred from an upstream side to a downstream side of a medium passage comprising:

a guide having a surface against which a medium that has had the liquid ejected thereon abuts;

a first medium driving member configured and arranged to drive the medium with a first driving speed, the first medium driving member being disposed at an upstream side of the guide along the medium passage;

a second medium driving member configured and arranged to drive the medium with a second driving speed, the second medium driving member being disposed at a downstream side of the guide along the medium passage;

a heating section capable of heating the medium, the heating section being disposed at a position facing the surface of the guide; and a cooling section capable of cooling the medium that has been heated by the heating section, the cooling section being disposed at a position facing the surface of the guide with the medium being interposed between the cooling section and the surface of the guide, the second driving speed being faster than the first driving speed.

2. The drying device according to claim 1, wherein the guide is a transport drum that has a cylindrical form and that transports the medium on a circumferential surface of the transport drum.

3. The drying device according to claim 1, wherein the guide abuts against the medium and includes a convex curved surface that protrudes toward the medium.

4. The drying device according to claim 1, wherein the medium is formed of a plurality of layers.

5. The drying device according to claim 4, wherein the plurality of layers include a first layer and a second layer; and the first layer and the second layer are detachably attached to each other.

6. The drying device according to claim 5, wherein the first layer has a lower heat resistance than a heat resistance of the second layer.

7. The drying device according to claim 6, wherein the first layer deforms at a lower temperature than a temperature that allows deformation of the second layer.

8. The drying device according to claim 1, wherein a pressing force pressing the medium against the surface of the guide is generated throughout the medium from a contact start point and a contact end point between the medium and the surface of the guide.

9. The drying device according to claim 8, wherein the heating section heats a portion of the medium located between the contact start point and the contact end point.

10. The drying device according to claim 8, wherein the cooling section cools a portion of the medium located between the contact start point and the contact end point.

11. The drying device according to claim 1, wherein the heating by the heating section and the cooling by the cooling section are performed while keeping the medium in contact with the surface of the guide.

12. A printing apparatus comprising:

an ejecting section configured and arranged to eject a liquid onto a medium; and the drying device according to claim 1.

13. A printing apparatus comprising:

an ejecting section configured and arranged to eject a liquid onto a medium; and the drying device according to claim 2.

14. A printing apparatus comprising:

an ejecting section configured and arranged to eject a liquid onto a medium; and the drying device according to claim 3.

15. A drying method for drying a medium that has had a liquid ejected thereon and has been transferred from an upstream side to a downstream side of a medium passage, the drying method comprising:

abutting a medium that has had the liquid ejected thereon against a surface of a guide;

driving the medium with a first driving speed by a first medium driving member configured and arranged to drive the medium and disposed at an upstream side of the guide along the medium passage;

driving the medium with a second driving speed by a second medium driving member configured and arranged to drive the medium and disposed at a downstream side of the guide along the medium passage;

heating the medium, and cooling the medium that has been heated in a state in which the medium abuts against the surface of the guide, the cooling being performed by a cooling section disposed at a position facing the surface of the guide with the medium being interposed between the cooling section and the surface of the guide, the second driving speed being faster than the first driving speed.

16. The drying method according to claim 15, wherein the guide is a transport drum having a cylindrical form and transporting the medium along a circumferential surface of the transport drum.

17. The drying method according to claim 15, wherein the guide includes a convex curved surface that protrudes toward the medium.

18. The drying method according to claim 15, wherein the abutting and the driving are performed while a pressing force pressing the medium against the surface of the guide is generated on the medium from a contact start point to a contact end point between the surface of the guide and the medium.

19. The drying method according to claim 18, wherein the heating heats a portion of the medium located between the contact start point and the contact end point.

20. The drying method according to claim 18, wherein the cooling cools a portion of the medium located between the contact start point and the contact end point.

* * * * *